US006050282A

United States Patent [19]

Whaley

[11] Patent Number: 6,050,282

[45] Date of Patent: Apr. 18, 2000

[54] BATCH MIXING CONTROL METHOD AND APPARATUS

[75] Inventor: Alvin W. Whaley, Dalton, Ga.

[73] Assignee: Kuesters Corporation, Spartanburg, S.C.

[21] Appl. No.: 08/962,180

[22] Filed: Oct. 31, 1997

[51] Int. Cl.[7] ..... E03B 1/00; F17D 1/14

[52] U.S. Cl. ..... 137/3; 137/597; 137/101.25; 137/563; 137/255

[58] Field of Search ..... 137/255, 263, 137/266, 563, 101.25, 597, 624.11, 606, 1, 3

[56] References Cited

U.S. PATENT DOCUMENTS 3,503,411 3/1970 Bauer ..... 137/101.25
4,632,147 12/1986 Whaley ..... 137/563
4,710,993 12/1987 Whaley ..... 137/1 X

*Primary Examiner*—Denise L. Ferensic
*Assistant Examiner*—Joanne Y. Kim
*Attorney, Agent, or Firm*—Kenyon & Kenyon

[57] ABSTRACT

A batch system wherein a constant, metered flow, is established for each of the ingredients of the batch. Having a constant flow rate and constant pressure in the fluid flow, a diverter valve diverts the flow for a predetermined length of time to yield a predetermined volume of each ingredient. Since each ingredient is in a separate flow path, the diverter valve can provide one ingredient at a time, or a plurality of ingredients at a time. A computer controlling the system stores various recipes or batch formulas.

17 Claims, 2 Drawing Sheets

BATCH MIXING CONTROL METHOD AND APPARATUS

FIELD OF THE INVENTION

The present invention relates generally to the mixing of a plurality of liquids, and more particularly to a method and apparatus for automatically mixing batches according to a predetermined recipe.

RELATED TECHNOLOGY

The commonly used system for mixing batches of a given material are gravimetric. In general, one supplies a first ingredient until a certain weight is reached, then supplies a second ingredient until a certain weight is reached, and so on until all ingredients have been dispensed. While this technique is theoretically sound, it is difficult to implement with the desired precision.

In the past, batch mixing apparatus has been done by hand, so a person must read a scale and open and close valves as apparatus. Later, the scales contained sensors at certain preset points to open and close valves; and, currently, computers are used to open and close valves in response to input from scales. All these are substantially the same system, and all have the draw-backs of poor accuracy and lack of repeatability within sufficiently close tolerances. The computer controlled system has improved the accuracy and repeatability, but there are inherent problems in accurately measuring fluid flow while a valve is ramped open, and is later ramped closed. The changing volume is difficult to measure, and the precise cut-off point is difficult to determine. Additionally, the software to control the process requires difficult routines that do not yield the desired repeatability in the batches.

SUMMARY OF THE INVENTION

The present invention provides a batch system wherein a constant, metered flow, is established for each of the ingredients of the batch. Having a constant flow rate and constant pressure in the fluid flow, a diverter valve diverts the flow for a predetermined length of time to yield a predetermined volume of each ingredient. Since each ingredient is in a separate flow path, the diverter valve can provide one ingredient at a time, or a plurality of ingredients at a time. In either case, a batch comprising a plurality of different ingredients can be provided very quickly. Furthermore, the recipe can be changed for a completely different batch very quickly. The computer controlling the system will have various recipes, and a different selection of ingredients may be made, and different quantities may be used.

BRIEF DESCRIPTION OF THE DRAWINGS

These and other features and advantages of the present invention will become apparent from consideration of the following specification when taken in conjunction with the accompanying drawings in which.

DETAILED DESCRIPTION

Figure 1:
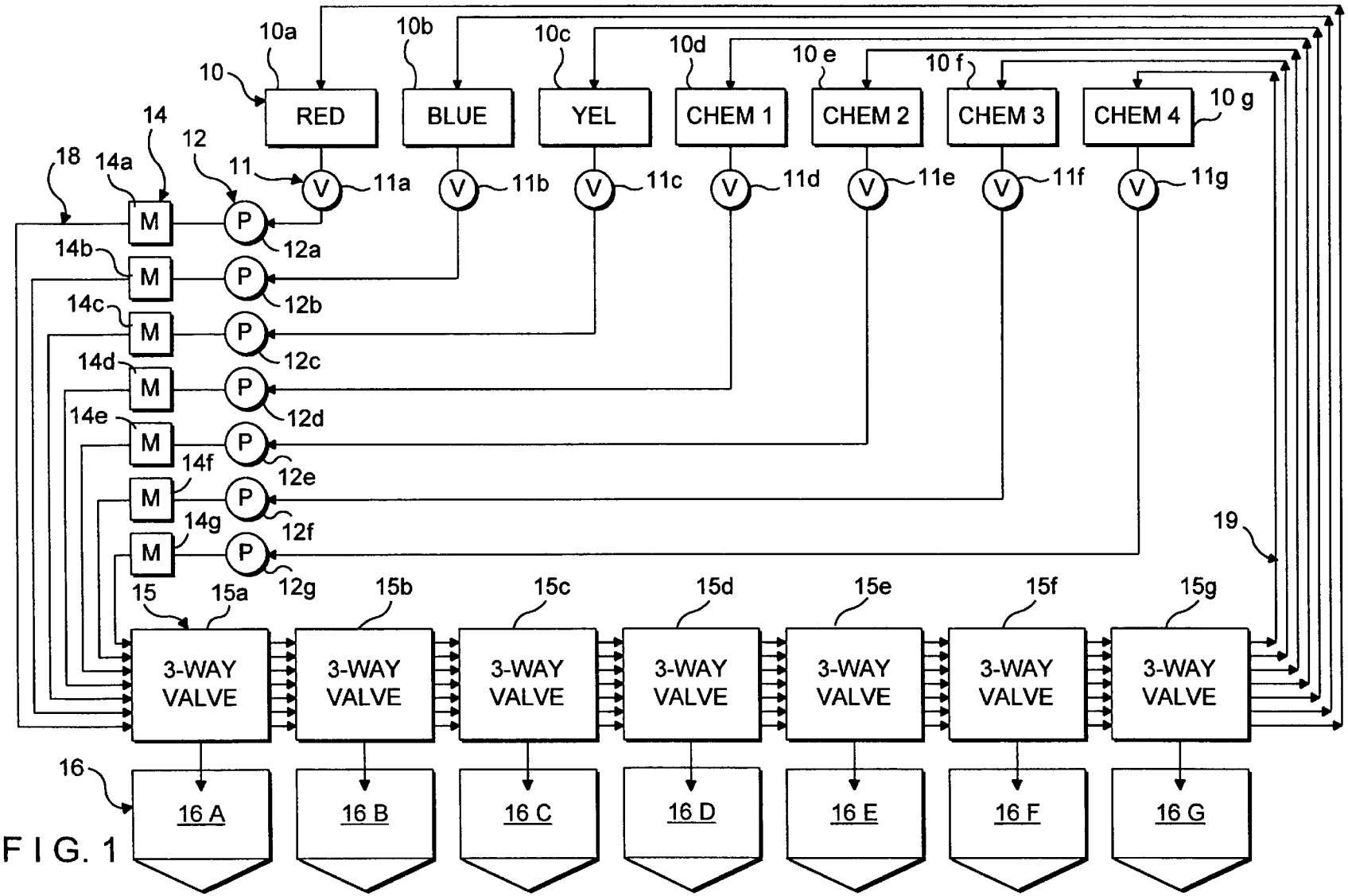
FIG. 1 is a schematic diagram showing a batch mixing system made in accordance with the present invention; and, FIG. 2 is a flow chart showing the logic of the computer controller for use in the system in the present invention.

Referring now more particularly to the drawings and to the embodiment of the invention here presented by way of illustration, FIG. 1 schematically illustrates a batch mixing system made in accordance with the present invention. It will be seen that there is a plurality of storage tanks 10, the individual tanks being designated as 10*a,* 10*b,* . . . 10*g*. It should be understood that the storage tanks 10 may be of any size desired, depending on the size of the batches to be made. Thus, if the batches are in the vicinity of a liter or so, the storage tanks may hold just a few hundred liters or so. If the batches are to be quite large, such as several hundred liters, the storage tanks 10 may be rail-car size or the like. The system of the present invention works the same, and works equally well, whether the storage tanks 10 are large or small.

The storage tanks 10 are in a flow loop so that the liquid in the tank can be pumped out of the tank, carried around the loop, and returned to the tank. In every case, the liquid moving around the loop will be a known pressure and a known flow rate.

As the liquid leaves the storage tank 10*a* (for example), the liquid passes through the valve 11*a*. The valve 11*a* allows the fine tuning as necessary to restrict the flow of the liquid to obtain the desired flow rates. The liquid then enters a pump 12*a* which is the pump that causes the liquid to move around the loop. The discharge from the pump 12*a,* then, enters the meter 14*a* which indicates the flow rate. The liquid next enters the three-way valve 15*a* which is adjacent to a batch tank 16*a.* +16

Considering the three-way valve 15*a* further, it will be noticed that there are seven lines entering valve 15*a.* The seven lines are from the seven storage tanks 10*a*–10*g,* which pass through the valves 11*a*–11*g,* through pumps 12*a*–12*g,* and meters 14*a*–14*g,* then to the three-way valves 15*a*–15*g*. Thus, though not shown in detail, it should be understood that the valve 15*a* (for example) actually comprises seven three-way valves, one on each of the seven incoming lines. Each of these individual valves is separately controllable by the microprocessor to switch between a recirculate position, where the flow in the loop continues on, and a dispense position, where the flow is diverted, so that at any time, any one of the valves in valve 15*a* can be sifted to cause the liquid in the associated line to flow into the batch container 16*a* instead of continuing through the loop.

Since the flow rate in the lines 18 is carefully controlled, diversion of the liquid flow for a predetermined time will result in a predetermined volume of material in the batch container 16*a*.

It will therefore be understood that the material will flow from the storage tanks 10, through the valves 11 and to the pumps 12. From the pumps 12, material flows through the lines 18 and to the three-way valves 15. Each of the lines 18*a*–18*g* may be diverted at any one of the batch tanks 16*a*–16*g;* if not, the material will pass on to the next valve 15. If the line is not diverted, the material will flow through the lines 19 and back to the storage tanks 10. It will therefore be understood that material will flow in a recirculating loop, from the storage tanks 10 and back, unless the material is diverted by one of the valves 15. Since the material is controlled to flow at a fixed rate, when the material is diverted, the length of time the material is diverted will determine the volume of the material diverted.

Those skilled in the art will understand that any number of storage tanks 10 may be provided, so long as the other elements in the loop are provided. As shown in the drawing, the system is for the usual carpet dyeing system and includes the three primary colors red, blue and yellow. In addition there are various chemicals to assist in the dyeing process.

Conventionally, there may be an acid to adjust the pH of the mixture, a fabric softener, a water softener and a wetting agent. Additional, or other chemicals may be used as desired; and, in systems other than carpet dyeing, any desired chemicals or liquids may be used.

In using the system of the present invention, when a given recipe is to be mixed the required ingredients are selected and placed within the storage tanks 10. The pumps 12 and valves 11 are then set to establish a carefully controlled flow through the loops connected to the appropriate storage tanks.

With a known flow rate through each of the lines 18, the individual three-way valves will be shifted for discrete periods of time. The time of diversion will vary with the quantity of the particular material required for the recipe. Since all the ingredients are flowing simultaneously through the various loop, it will be understood that any number of the individual valves 15 can be shifted at any given time so the complete batch can be mixed very quickly. The provision of seven batch tanks 16 is for the purpose of mixing seven different batches, which may be the same recipe or different recipes.

Preferably, some of the tanks and flow loops are especially suited for small quantity delivery. Often a batch will require that only small amounts of a particular element, for example a dye, be delivered. For these loops, the meters 14 preferably are accurate mass flow meters.

Figure 2:
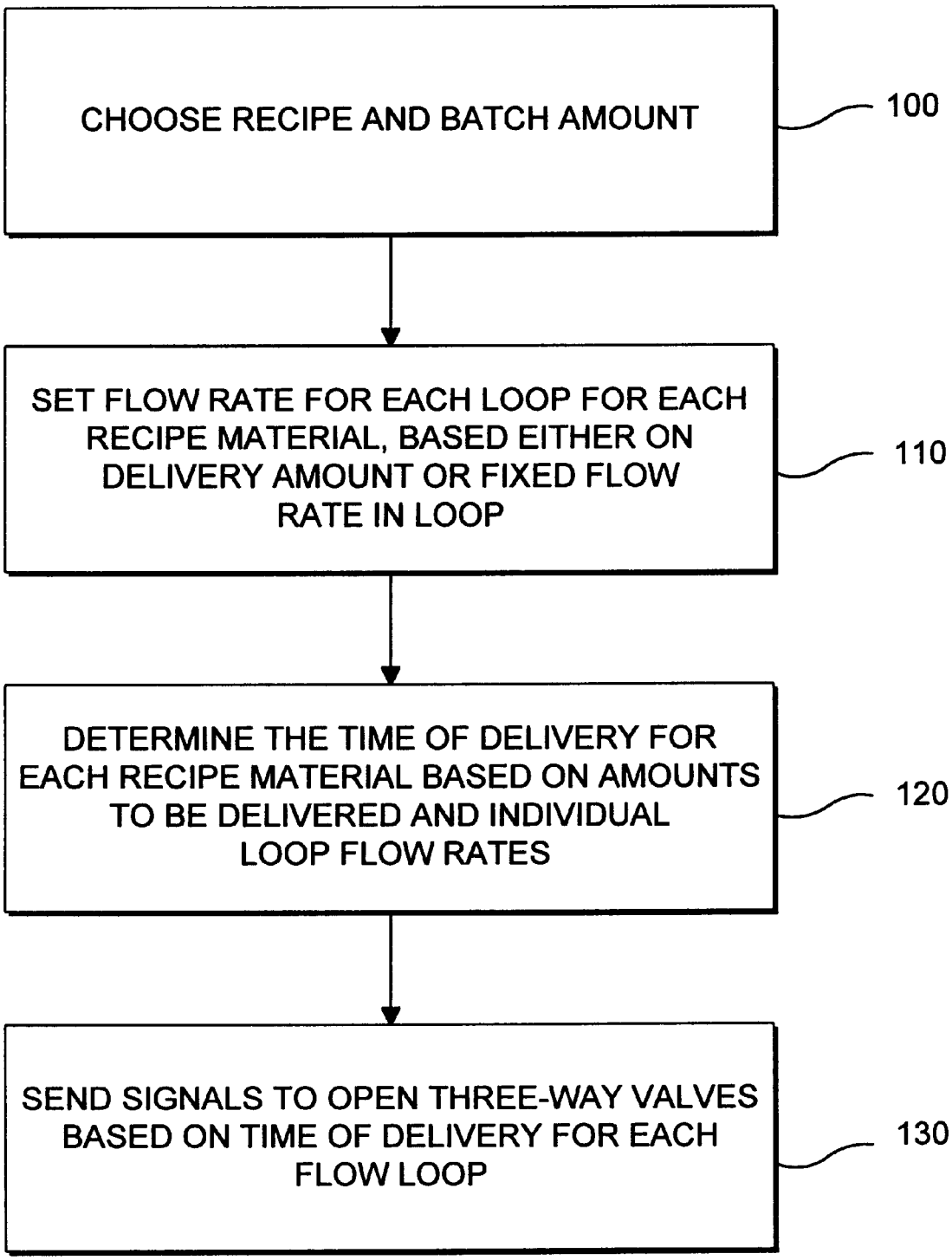

FIG. 2 shows a flow chart of control software for an embodiment of the present invention with six tanks for dispensing three dyes, acid, gum and water. A standard microprocessor and memory device from a PC can be used to operate the software. The memory device can store a set of predetermined recipes or formulas, for example corresponding to certain colors made from different dyes. As shown in block 100, the operator chooses one of these recipes along with the batch amount. Then in block 110, depending on the amount of fluid from each tank to be dispensed and what material the tank is dispensing, a flow rate for each recirculated loop is established. The amount of fluid to be dispatched is determined from the formula and from the batch amount. As an example, typical formulas may require dyes, acid, gum and water and the dye rates can be measured by accurate mass flow meters, while the acid, gum and water rates are measured by magnetic flow meters. For dye and acid amounts equal to or less than 250 grams, the flow rate may set at 250 grams per minute. For amounts from 250 grams to 1000 grams, the flow rate is set at 1000 grams per minute, and for amounts above a thousand grams, the flow rate of the loop is set at 10,000 grams per minute (or if a standard magnetic flow meter is used, at 10 liters per minute), which for the example is the maximum flow rate allowable for a single loop. For the gum loop, a set rate of 25 liters per minute is used by the microprocessor, and for the water loop a set rate of 200 liters per minute. These flow rates permit rapid delivery of a batch with excellent accuracy. The flow rates thus may be established for each of the loops. As shown in block 120, the microprocessor determines the amount of time each valve should be open to deliver the proper amount of fluid based on the flow rate. As shown in block 130, the three-way valves of valve 15*a* (as stated valve 15*a* actually comprises a plurality of 3-way valves) are then opened, each for the proper time, to form the batch. The valves can also be opened sequentially so that the last loop, often of water or another base, fills up the tank until a level probe is matched, the level probe being set by the microprocessor to the desired batch amount. The tank can then be mixed.

As an example, a batch amount for a certain color can be made from different proportions of primary color dyes of red, blue and yellow in an acid, gum and water base. The operator selects the desired color formula and, as an example, a batch amount of 100 liters. Based on the formula in memory, the computer determines that for that color, yellow dye in the proportion of 0.1 grams/liter of batch amount needs to be dispensed, red dye in the proportion of 0.8 grams/liter, blue dye in the proportion of 1.5 grams/liter, acid of 50 grams/liter, with gum forming 50 percent of the batch size and water the rest of the batch amount. The final amounts determined by the microprocessor of the computer based on a 100 liter batch size are then 10 grams yellow dye, 80 grams red dye, 150 grams blue dye, 5 liters of acid (with acid being estimated to have a density of 1 kg/liter), 50 liters of gum and water being 44.760 liters. The computer estimates the water amount by estimating the dyes to have a density of 1 kg/liter, so that the water amount is determined as 100 liters—55 liters gum and acid—0.24 liters dye.

The dye loops are then recirculated at 250 grams per minute (as the dye amounts to be delivered are less than 250 grams), the acid loop at 10 liters per minute, the gum loop at 25 liters per minute and the water loop at 200 liters per minute. The yellow dye 3-way valve is then opened for 2.400 seconds, the red dye 3-way valve 19.203 seconds, the blue dye 3-way valve 36.005 seconds, the acid 3-way valve 30.000 seconds, and the gum loop 3-way valve 120 seconds. These valves are all opened at the same time. Then after the 120 seconds is complete, the water is dispensed until the 100 liter probe is activated. The mixer is turned on and the batch is complete. The above is however just an example, and it is possible to time the water delivery without using a probe and also to deliver the different fluids sequentially or all at once.

The pumps of the present invention may be OBERDORFER model #207641, the valves 11 HAYWARD, model #RV10075, the mass flow meters MICRO MOTION CMF025, the 3-way valves TUFLINE ¾ inch, 0336D, the level probe NATIONAL CONTROLS, LNC NS129-120, and the connecting tubing 3/16 inch stainless steel.

It will of course be understood that the particular embodiment of the invention here presented is by way of illustration only, and is meant to be in no way restrictive; therefore, numerous changes and modifications can be made, and full use of the equivalents resorted to, without departing from the spirit or scope of the invention in the appended claims.

What is claimed is:

1. A method for preparing a batch having a plurality of components, the method comprising the steps of:

selecting a desired batch amount;

establishing a rate of flow of a first component of the plurality of components;

establishing a rate of flow of a second component of the plurality of components;

determining a first time of delivery for the first component;

determining a second time of delivery for the second component;

delivering the first component based on the first time of delivery; and delivering the second component based on the second time of delivery.

2. The method as recited in claim 1 wherein the step of delivering the first component is performed by switching a three-way valve.

3. The method as recited in claim 1 further comprising the step of establishing a rate of flow of a third component of the plurality of components.

4. The method as recited in claim 1 further comprising the step of delivering a third component of the plurality of components.

5. The method as recited in claim 4 wherein the third component is delivered until a predetermined level in a tank is reached.

6. The method as recited in claim 1 further comprising the step of preloading a plurality of batch recipes into a memory.

7. The method as recited in claim 6 further comprising the step of selecting a recipe for the batch from the plurality of batch recipes.

8. The method as recited in claim 1 wherein the time of delivery for the first component is determined as a function of a recipe for the batch.

9. The method as recited in claim 1 wherein the first component is a first dye having a first color and the second component is a second dye having a second color and the batch has a desired color which is a function of the first color and the second color.

10. The method as recited in claim 9 wherein the desired color is further a function of the first time of delivery, the second time of delivery and the rates of flow of the first and second components.

11. Apparatus for the delivery of a desired batch amount, the batch having a plurality of components, the apparatus comprising:

a plurality of individual flow loops for conveying corresponding individual components, a rate of flow of a first of the plurality of components being established in a first of the plurality of individual flows loops and a rate of flow of a second of the plurality of components being established in a second of the plurality of individual flows loops; a microprocessor for determining a first time of delivery for the first component and a second time of delivery for the second component;

a flow meter associated with each flow loop, each flow meter providing an input to the microprocessor;

a diverter valve associated with each flow loop, each diverter valve having an input from the microprocessor and having a recirculate position and a delivery position for delivering a corresponding component, a first diverter valve in the first flow loop delivering the first component based on the first time of delivery and a second diverter valve in the second flow loop delivering the second component based on the second time of delivery; and a pump associated with each flow loop.

12. The apparatus as recited in claim 11 further comprising a first tank for receiving the batch when at least one of the diverter valves is in a delivery position.

13. The apparatus as recited in claim 11 further comprising a second diverter valve associated with each flow loop.

14. The apparatus as recited in claim 13 further comprising a first tank for receiving the batch, and a second tank for receiving another batch from the second diverter valves.

15. The apparatus as recited in claim 11 further comprising a valve and a storage tank associated with each flow loop, the valve located directly between the storage tank and the pump of each flow loop.

16. The apparatus as recited in claim 11 wherein the flow meter is a mass flow meter.

17. The apparatus as recited in claim 11 wherein the diverter valve is a three-way valve.

* * * * *